US005385183A

United States Patent [19]

Ferranti

[11] Patent Number: 5,385,183

[45] Date of Patent: Jan. 31, 1995

[54] TOOL FOR PRODUCING STRAIGHT EDGE

[76] Inventor: Thomas Ferranti, 5 Hamilton Rd., Whitehouse Station, N.J. 08889

[21] Appl. No.: 31,690

[22] Filed: Mar. 15, 1993

[51] Int. Cl.[6] ..... B27C 5/00

[52] U.S. Cl. ..... 144/144.5 R; 33/411; 33/430; 83/745; 144/307; 144/144 R; 269/53; 269/541; 269/54.5; 269/208

[58] Field of Search ..... 33/403, 411, 429, 430, 33/443, 446; 83/745; 144/144 R, 144.5, 307; 269/53, 54.1, 54.5, 165, 171.5, 127, 188, 189, 207, 208

[56] References Cited

U.S. PATENT DOCUMENTS

| | | | |
|---|---|---|---|
| 247,894 | 10/1881 | Doyle | 144/307 |
| 810,246 | 1/1906 | Anderson | 33/411 |
| 2,957,507 | 10/1960 | Vargo | 144/144.5 |
| 2,969,817 | 1/1961 | Zabich | 144/307 |
| 3,914,830 | 10/1975 | Bolton | 269/171.5 |
| 4,164,882 | 8/1979 | Moricle | 83/745 |
| 4,176,572 | 12/1979 | Pennington | 83/574 |
| 4,179,965 | 12/1979 | Johnson | 83/745 |
| 4,524,662 | 6/1985 | Carley | 83/745 |
| 4,905,745 | 3/1990 | Jaeger | 144/144 R |

*Primary Examiner*—W. Donald Bray
*Attorney, Agent, or Firm*—Mitchell P. Novick

[57] ABSTRACT

A tool for assisting in producing a straight edge on a piece of rough cut raw material, such as lumber or masonite. The tool is held in place on top of the piece by gripping means which grip the piece along two opposite side edges. The tool's straight edge, unobstructed by clamps or other protrusions, is then used as a guide to bank against the saw fence of a table saw, radial arm saw, or circular saw, producing a straight edge on the piece. Using the tool, one can take the flat bow out of a piece and also remove the rough mill edge. The tool can also be used with a hand circular saw, jig saw, or router by running the saw directly along the tool's unobstructed straight edge.

5 Claims, 1 Drawing Sheet

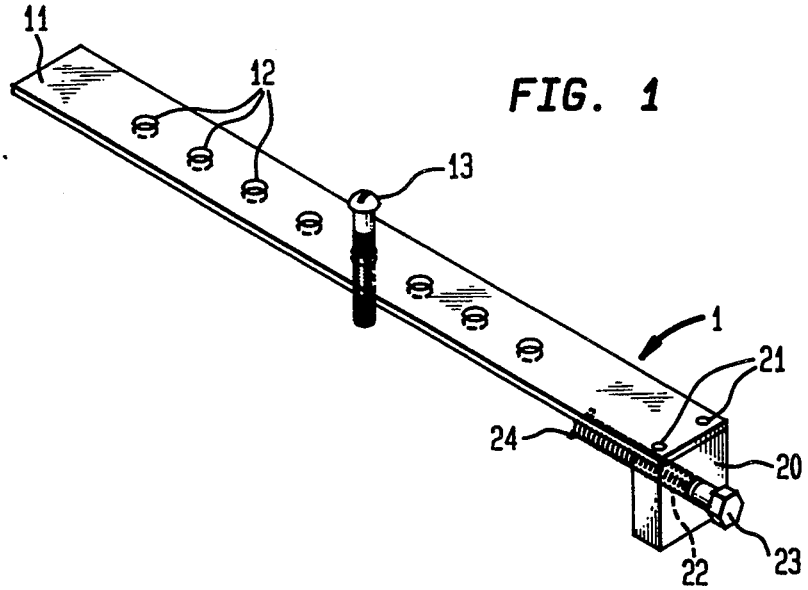
FIG. 1
FIG. 2
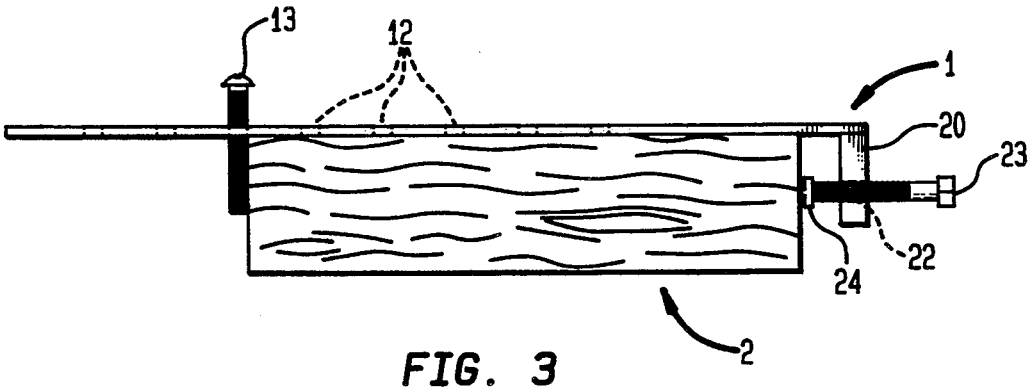
FIG. 3
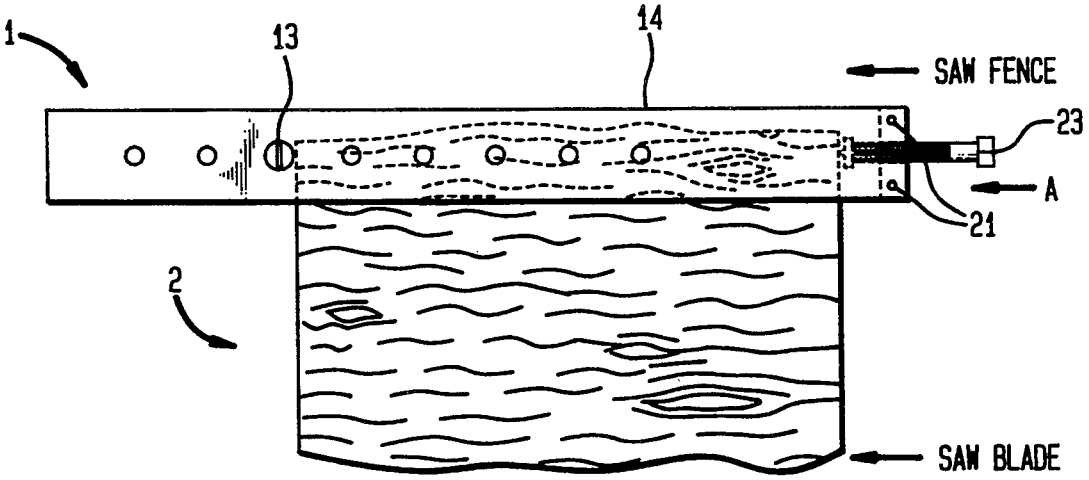

TOOL FOR PRODUCING STRAIGHT EDGE

BACKGROUND OF THE INVENTION

1. Field of the Invention

This invention relates to craftsman's tools and more particularly to tools designed to produce a straight, smooth edge on a piece of lumber or other material which may have a "crook" or flat bow or rough mill edges.

2. Description of the Prior Art

In working with sheets or boards of raw material, such as wood, plywood, or masonite, there is always an interest in minimizing costs to maximize profits and reduce waste. For instance, in woodworking, one can save substantial amounts of money by purchasing unfinished, rough mill lumber. Sometimes, the desired lumber is only available in unfinished form. Regardless, the raw material needs at least one straight, smooth edge as a reference edge for future shaping and cutting.

Prior art discloses devices or tools developed to take advantage of the lower prices for rough cut lumber, while seeking ways to guarantee straight edges on lumber and other building materials to be used as furniture, cabinets, counter tops, wall boards, paneling, and for many other purposes including, but not limited to, general construction purposes.

In general, these prior art devices include independent clamps of various designs and flat bars which use clamps or screws for attachment to the lumber or other material to be cut.

A typical prior art device comprises two clamps. One end of each clamp is tightened around one edge of a known straight board; the other end is tightened to the bowed board. The unobstructed end of the straight board is then used as the contact surface to a saw fence or guide to make a straight cut along the bowed board. This method requires a constant examination of the straight board to determine any warpness or damage from use and a constant checking of the integrity and tightness of the clamps used to prevent relative movement between the straight and bowed lumber prior to and while sawing.

Other prior art devices include cutting guides usually made of aluminum. Some of these are of fixed length while others can be lengthened for cutting longer pieces of wood, wallboard, masonite, and paneling. These devices attach by clamps to the board being cut. These clamps may be the well-known "C" clamps (screw type). In use, a plurality of "C" clamps are placed around both the guide and the board, and holds them together by frictional forces created by compression across the thickness of the guide and the board.

Alternatively, jaw-type clamps may be used. A plurality of these clamps are typically rigidly attached to the underside of the guide. The jaws then are positioned around the board to be cut across its thickness and are clamped shut by pressing a lever. As with the "C" clamps, the board is held relative to the guide by frictional forces created by compression across the thickness of the board.

All of these prior art devices are very difficult to use with a saw fence due to the interferences caused by clamps protruding to the side or below the surface of the board to be cut. Furthermore, under the intense vibrational forces occurring during sawing often loosen the compression-type hold on the board, resulting in board movement and a non-straight cut along the board.

Thus, there remains a significant need for a tool or saw guide designed to eliminate the flat bow out of rough cut mill lumber of varying lengths or other materials and provide a near perfect saw cut edge while also allowing the use of a standard table saw, radial saw, or circular saw.

SUMMARY OF THE INVENTION

A primary object of the instant invention is a tool which is designed to eliminate the flat bow out of rough cut mill lumber or other materials.

Another object of this invention is a tool which can be used with several cutting instruments such as a table saw, radial arm saw, circular saw, router, and jig saw without any protruding or obstructing clamps, knobs or brackets on any side of the rough lumber or other material.

Still another object of this invention is a tool which is adjustable to accommodate varying lengths of rough cut lumber or other materials.

Still another object of this invention is a tool in which the guide and associated clamping mechanisms are contained are an integral unit and not separate of each other as other designs which include a separate bar, separate clamps and separate screws which can be easily misplaced or loosened with use.

Another object of this invention is a tool which minimizes waste in the use of rough mill lumber or other materials.

In short, this invention is a bar of metal or plastic that has an integral clamping mechanism to grip a piece of lumber or masonite by two opposite edges of the piece. At least one edge of the strip is a permanent straight edge, which can be banked against a saw guide when sawing the piece. The saw then produces a straight edge on the piece parallel to the saw guide.

BRIEF DESCRIPTION OF DRAWINGS

FIG. 1 is a perspective view of the tool.

FIG. 2 is a side view of the tool shown in FIG. 1, with a piece of material being held in place.

FIG. 3 is a top view of the setup shown in FIG. 2, the tool holding a piece of material.

DESCRIPTION OF PREFERRED EMBODIMENT

In its preferred embodiment, this invention is a tool 1 for creating a near perfect saw cut edge on rough cut lumber or other materials 2. The tool 1 is preferably manufactured in different lengths and made of 6061T6 Aluminum. This tool 1 is comprised of a flat, rectangular bar 11 containing a plurality of equidiameter holes 12 completely passing through the thickness of the bar 11. Preferably, the bar 11 contains 16 holes 12 each having a diameter of 0.21 inches spaced evenly at $1\frac{5}{8}$ inches between centers to allow for an approximately 24 inch span of holes 12. The holes 12 are also preferably threaded to accommodate a 3/16 inch diameter threaded screw 13 with 10/32 inch threads. The bar 11 is preferably 3 inches wide and varies in length as with the length of material 2 to be accommodated; however, the bar 11 accommodates a raw material 2 of length $\frac{1}{2}$ inch longer than the longest intended finished material 2 length (e.g., for a maximum finished length of 4 feet, the raw material length may be up to 4 feet, $\frac{1}{2}$ inch). The bar 11 is also thin enough to flex when attached to a piece of material 2, which may not be perfectly flat, and used with a saw (not shown); a preferable thickness is 3/16 inches.

At one end of the bar 11, a tension block 20 is secured to the underside of the flat bar 11, preferably by two ¼ inch-20 thread bolts 21 which pass through the bar 11 and into corresponding No. 7 holes in an edge of the tension block 20, along the center line and spaced equally from the ends of that tension block edge. Preferably, the tension block 20 has dimensions ⅝ inch by ⅝ inch and matches the width of the bar 11, to prevent bending under stress. The tension block 20 has a horizontal threaded hole 22 for a tension bolt 23, which serves as a final adjustment to secure the material 2 to be cut. The threaded hole 22 has preferable dimensions of 5/16 inch diameter and 18 threads per inch and is located off-center to the left side of the tension block 20 viewing the tension block from direction A; this layout accommodates the typical saw relationship in which the saw fence is to the right of the cutting direction of the saw blade. The tension bolt 23 has a preferable length of 3 inches (more than the 1⅝ inches distance between centers of the holes 12), a diameter of ¼ inch and 20 threads per inch, complementary to those threads of the hole 22.

To further assist the tension bolt 23 in securing the material 2, the bolt 23 preferably includes a ⅝ inch hexagonal nut on one end and a machined ¼ inch nut, ⅝ inch disk, and 3/16 inch diameter center tapering to a point 24 in a length of 3/16 inch.

The tool 1 is used in the following manner. The tool 1 is available in different lengths to accommodate varying pieces of lumber or other material 2 with a flat bow and with rough mill edges. For safety reasons, dimensions for the material 2 should be wider than 3 ½ inches and thicker than ¾ inch, although thinner material could be used. A particular tool 1 is chosen of length appropriate for the chosen material 2.

The material 2 is placed underneath the tool 1 against the tension block 20. The projecting screw 13 is threaded through the nearest hole beyond the far edge of the material 2. The tension bolt 23 is tightened in the tension hole 22 until the tension bolt 23 is snugly against the near edge of the material 2. The off-center location of the tension hole 22 allows the tool 1 to accommodate and secure a piece of material with a relatively severe crook; a severe crook is placed in the direction between the tension hole 22 and the right edge of the tension block 23.

The point 24 pierces the material 2, further securing the tool 1 to the material 2. The threads on the projecting screw 13 also pierce the material 2, helping to prevent the material 2 from slipping away from the tool 1.

Thus, the material 2 is held securely between the projecting screw 13, the tension bolt 23, and the underside of the tool 1. This configuration allows the tool 1 to overhang the material 2 and an edge 14 of the tool 1 to be used to contact a saw fence (not shown) of a table saw, radial saw, or circular saw, guiding the saw blade (not shown) to produce one straight smooth cut saw edge on the material 2.

The tool 1 is then released from the cut material 2 by loosening the tension bolt 23. The material 2 can now be further processed by well-known methods of producing a parallel edge, right angles, triangular cuts, etc.

Finally, a finishing step trims approximately ½ inch of end trimming from the material 2, thereby removing marks made by the tension bolt point 24 and threads of the projecting screw 13. This step also removes any remaining saw mill marks.

Although this invention has been described with a certain degree of particularity, it is to be understood that the present disclosure has been made only by way of illustration and that numerous changes in the details of construction and arrangement of parts may be resorted to without departing from the spirit and scope of this invention. For example, the tool 1 may be manufactured in different lengths and widths, may contain different number of holes 12 and spacing of holes 12 in the bar 11, and may be made from plastic. Also, the tool 1 may be set up so as not to overhang the material 2, and the tool edge 14 can be used directly as a hand saw guide (the saw passes along the tool edge 14).

Furthermore, because of the symmetric layout of the bolts 21, the tool 1 may be reversed, so that the tension hole 22 is to the right side of the tension block 20. One removes the bolts 21 securing the tension block 20 to the bar 11, flips over the bar 11 along its short axis (reversing the bar's top and bottom surfaces), and reinserts the bolts 21 to resecure the tension block 20 to the bar 11. Screw 13 is also removed and reinserted into the chosen hole 12 from the new top surface of the bar 11. This reversed layout accommodates a saw relationship in which the saw fence is to the left of the cutting direction of the saw blade.

I claim:

1. A tool for use in producing a straight edge on a piece of raw material, said piece having a first piece edge and a second piece edge opposite said first piece edge, said tool comprising:

(a) a bar having a bar straight edge and a bar long axis;

(b) clamping means to detachably clamp said piece between said first and second piece edges, said clamping means comprising penetrating means to penetrate at least one of said first and second piece edges, said clamping means being integral to said bar;

(c) said clamping means located within said bar other than along said bar straight edge; and (d) said clamping means further comprises first and second clamping portions; said first clamping portion comprising a first opening in said bar and a first bolt inserted through said first opening; said second clamp portion comprising a second opening in said bar and a second bolt inserted through said second opening.

2. A tool as described in claim 1 in which said first opening comprises one opening among a plurality of openings spaced along said bar long axis.

3. A tool as described in claim 1 in which said first and second clamp portions are perpendicular to each other along of said bar long axis.

4. A tool for use in producing a straight edge on a piece of raw material, said piece having a first piece edge and a second piece edge opposite said first piece edge, said tool comprising:

(a) a bar having a bar long axis and a bar straight edge;

(b) a plurality of pin openings along said bar long axis, each said pin opening having a pin opening axis generally perpendicular to said bar long axis;

(c) a pin being removably and selectively placed in, and passing through, one of said pin openings;

(d) a block attached to said bar perpendicular to said bar long axis; said block having a block opening, said block opening having an opening axis generally perpendicular to said pin opening axes; and (e) a bolt being removably placed in, and passing through, said block opening, said bolt comprising a bolt penetrating edge capable of penetrating said second piece edge;

(f) said pin being placeable along said first piece edge and said bolt being placeable along said second piece edge to securely hold said piece relative to said bar.

5. A tool as described in claim 4 in which said pin openings and said pin are complementary threaded, and said block opening and said bolt are complementary threaded.

* * * * *